United States Patent [19]

Shoemaker

[11] Patent Number: 4,665,999

[45] Date of Patent: May 19, 1987

[54] VARIABLE LENGTH THREE-CONE ROCK BIT NOZZLES

[76] Inventor: Ken S. Shoemaker, 4271 Kingsbury Pl., Riverside, Calif. 92503

[21] Appl. No.: 611,048

[22] Filed: May 16, 1984

[51] Int. Cl.[4] ..... E21B 10/18

[52] U.S. Cl. ..... 175/340; 175/393

[58] Field of Search ..... 175/340, 393, 922, 339

[56] References Cited

U.S. PATENT DOCUMENTS

| | | | |
|---|---|---|---|
| 1,945,258 | 1/1934 | Collins . | |
| 2,045,368 | 6/1936 | Reed . | |
| 2,644,671 | 7/1953 | Ingram | 175/340 |
| 2,710,741 | 6/1955 | Hall, Sr. . | |
| 2,754,091 | 7/1956 | Kucera | 175/340 |
| 3,923,109 | 12/1975 | Williams, Jr. | 175/340 |
| 4,068,731 | 1/1978 | Garner et al. | 175/339 |
| 4,187,921 | 2/1980 | Garner | 175/340 |
| 4,452,324 | 6/1984 | Jürgens | 175/393 |

FOREIGN PATENT DOCUMENTS

| | | | |
|---|---|---|---|
| 2272255 | 12/1975 | France | 175/340 |

*Primary Examiner*—Stephen J. Novosad
*Assistant Examiner*—William P. Neuder
*Attorney, Agent, or Firm*—Robert G. Upton

[57] ABSTRACT

This invention relates to multi-cone rock bits with three or more nozzles of varying length to affect different flow velocities from each of the nozzles. The nozzles at different lengths create a crossflow of fluid on a borehole bottom to lift detritus therefrom during rock bit drilling operations.

5 Claims, 5 Drawing Figures

VARIABLE LENGTH THREE-CONE ROCK BIT NOZZLES

BACKGROUND OF THE INVENTION

1. Field of the Invention

This invention relates to three-cone sealed bearing rock bits having at least three nozzles to enhance removal of rock chips from a borehole bottom.

More particularly, this invention relates to three-cone sealed bearing rock bits having three variable length nozzle bodies extending adjacent the cutting end of the bit; the variable length nozzles enhancing a crossflow of fluid to accelerate the removal of rock chips from a borehole bottom.

Rotary cone rock bits are primarily used in drilling for oil. In the drilling operation, as the drillstring rotates and the cutters on the borehole bottom thereof rotate relative to the bit, parts of the rock formation are cut or broken away. Drilling "mud" is circulated down through the drillstring or stem. The mud enters a chamber formed in the bit body and is directed against the bottom hole formation. The mud passes by the cutters to clear the cutter teeth of debris and picks up cuttings from the formation bottom and circulates them upwardly around the drill stem to the surface.

It has been found advantageous to extend circulation nozzles for the drilling mud downwardly, close to the bottom of the hole being drilled in the formation, to provide better scarifying and suspension of the formation particles in the mud for circulation upwardly and removal from the hole.

2. Description of the Prior Art

There are many patents describing nozzle means to accelerate fluid or mud towards the borehole bottom to accelerate removal of rock chips during operation of a rock bit in an earth formation.

For example, U.S. Pat. No. 1,945,258 describes a two-cone rock bit having water courses that are used primarily to prevent the jet velocity of the mud exiting the water courses from impacting the cutting structure on each of the two cones. This patent does not direct itself toward the enhancement of a crossflow of mud to accelerate removal of rock chips or detritus from the borehole bottom.

U.S. Pat. No. 2,045,368 describes, again, a two-cone rock bit with nozzles of equal distance and length. There is also a center jet in the dome of the rock bit. The center jet is normally used to prevent the rock bit from "balling" during bit operation. Balling occurs when detritus packs between the cones in the center of the bit. This patent, like the foregoing patent, does not teach a crossflow of fluid on the floor of the earth formation to enhance movement of detritus from the floor.

U.S. Pat. No. 2,710,741 describes a two or three-cone rock bit having a reverse flow wherein fluid escapes the drillstring above the pin end or threaded end of the rock bit to direct fluid toward the surface on the outside of the drillstring, thus enhancing removal of rock chips from the borehole bottom. There is, however, no means on the rock bit itself to enhance crossflow of fluids on the borehole bottom.

U.S. Pat. No. 4,068,731, assigned to the same assignee as the present invention, teaches a rotary drill bit with downwardly extended nozzle means, an outwardly facing portion of which serves as a bit stabilizer. The upper portion of the nozzle means is on a greater diameter than the lower portion thereof so that the lower portion is positioned radially inwardly from the borehole wall of the formation. The upper portion of the nozzle means is machined with a larger diameter than the lower portion—the upper portion being provided with hardened tungsten carbide flush-type inserts so that the upper portion of the nozzles will ream the borehole during bit operation.

This patent teaches a two-cone rock bit with a pair of nozzles extended toward the borehole bottom. The pair of nozzles are equal in length and direct fluid at the same rate toward the borehole bottom to remove rock chips from the borehole bottom.

This patent, however, does not teach a means to create a disturbance or crossflow of drilling mud to enhance more efficient removal of detritus from the borehole bottom.

U.S. Pat. No. 4,187,921, also assigned to the same assignee as the present invention, describes a means to enhance the crossflow of fluid to remove detritus from the borehole bottom. This invention teaches the use of one or more cavitation-inducing nozzles in combination with a conventional nozzle of a rock bit. The cavitation nozzle enhances the drilling rate by rapidly removing cuttings from the hole bottom. Cavitation from a cavitating nozzle positioned on one side of the bit reduces the pressure, thereby inducing drilling mud at higher pressure, passing through an opposing noncavitating nozzle to move across the rock-tooth interface. The resultant crossflow of mud removes the cuttings from the hole bottom.

While the principle taught in this patent is valid, it is sometimes difficult to achieve cavitation of the cavitating nozzles since the flow velocity through the cavitating nozzle and the depth of the bit has to be within fairly precise ranges to induce cavitation.

The present invention creates a crossflow or a circulation in the borehole bottom by utilizing three nozzle bodies of varying length whereby the distance from the exit end of each nozzle from the borehole bottom is different, thus creating different flow velocities at the borehole bottom. The varying flow velocities creates a positive crossflow of fluids across the borehole bottom to more effectively lift detritus or rock chips from the borehole bottom toward the surfce through the annulus created between the outside of the drillstring and the walls of the borehole itself.

SUMMARY OF THE INVENTION

It is an object of this invention to create a crossflow of drilling mud on the borehole bottom to lift detritus from the floor of the borehole to the surface during drilling operations.

More specifically, it is an object of this invention to provide a multi-cone rock bit with a multiplicity of nozzle bodies of varying length to create different flow velocities at the bottom of the borehole, thereby creating a crossflow of fluid on a borehole bottom to lift detritus from the bottom during rock bit operations.

A rotary cone rock bit of the type that utilizes drilling fluid during operation of the rock bit in earth formations consists of a rock bit body having a first pin end and a second cutting end. The second cutting end consists of one or more rotary cones mounted to journals that are cantilevered radially inwardly from legs extending from the rock bit body. A fluid chamber is formed by the body, the fluid chamber being opened to the first pin end of the body. At least three nozzle bodies extend from a dome portion formed at a base of the bit body. Two of the nozzle bodies extends further from the dome portion than the other of the nozzle bodies. The exit end of each of the nozzles is at a different length than the other of the nozzles relative to the bottom of the earth formation. The different length nozzle bodies result in different flow velocities at the borehole bottom, hence a crossflow of the fluid is created on the borehole bottom to enhance lifting of detritus therefrom.

The nozzles, for example, are fabricated from a wear resistant tungsten carbide material.

An advantage of the present invention over the prior art is the means in which a crossflow of fluid on the borehole bottom is accomplished to lift rock bit cuttings from the bottom of the borehole.

Another advantage of the present invention over the prior art is the manipulation of fluid passing through at least three nozzles to create a crossflow of fluids on the borehole bottom to lift detritus from the bottom during rock bit drilling operations.

Yet another advantage of the instant invention over the prior art is the varying length of each of the three separate nozzle bodies to vary the flow velocities of the fluid at the borehole bottom to create a crossflow of fluids on the borehole bottom to lift rock chips from the bottom during rock bit drilling operations.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
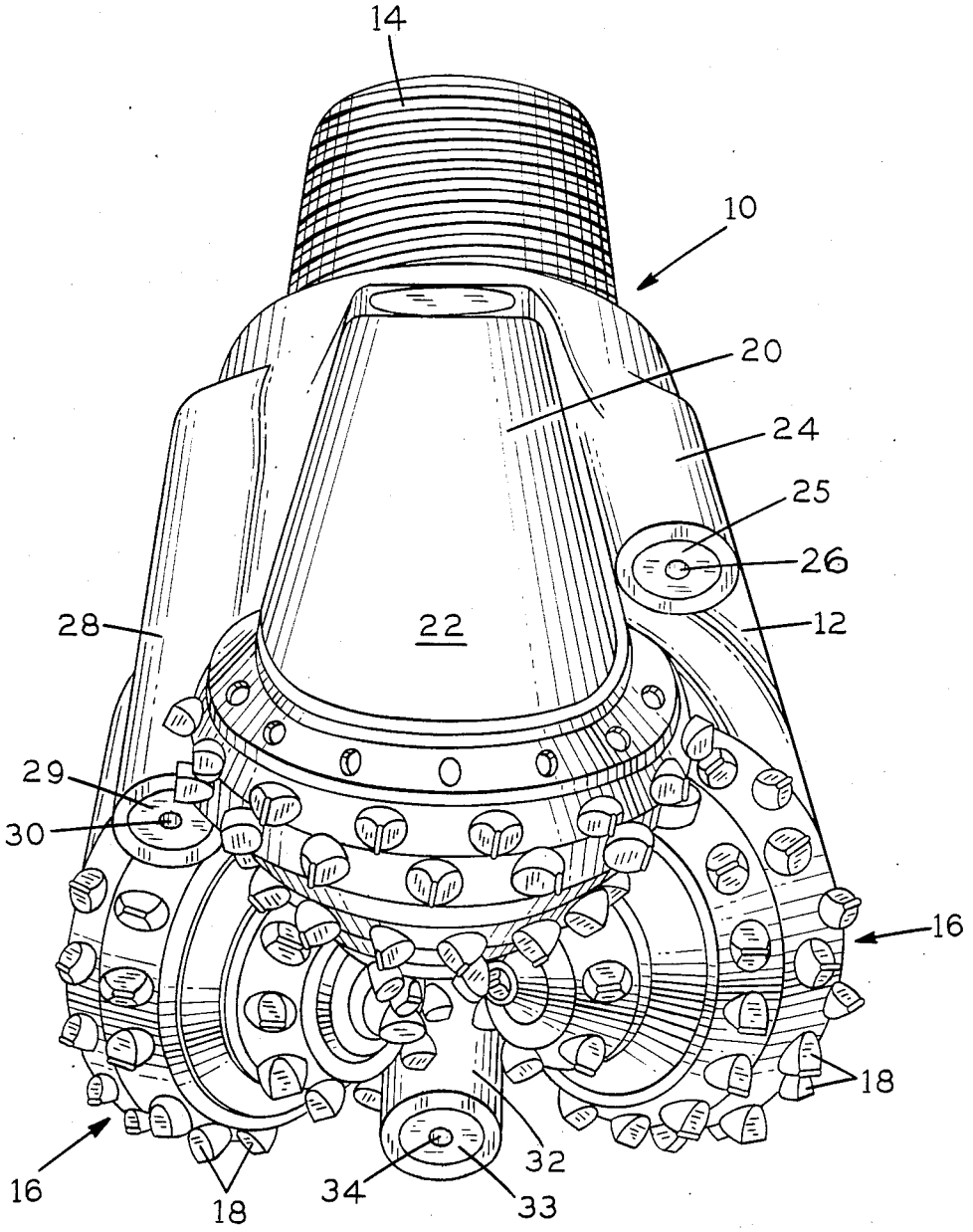
FIG. 1 is a perspective view of a sealed bearing rotary cone rock bit, illustrating three nozzles at varying lengths.
Figure 3:
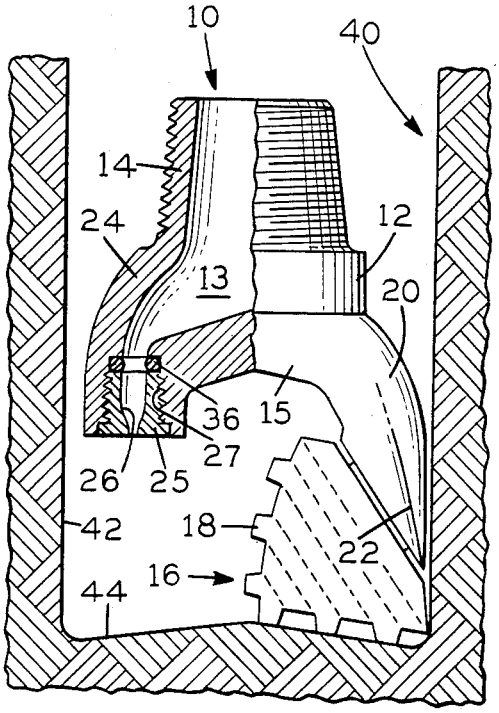
FIG. 3 is a partially cut away side view of a view taken through 3—3 of FIG. 2, illustrating the first of the variable length nozzles.
Figure 4:
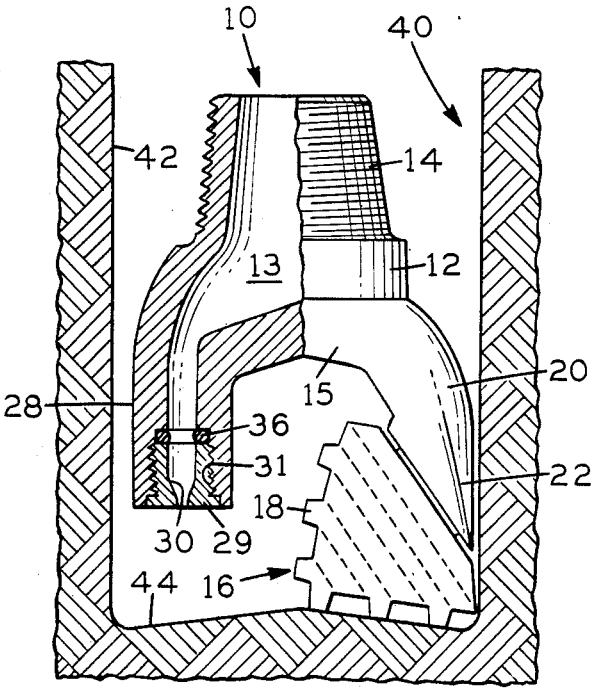
FIG. 4 is a partially cut away side view taken through 4—4 of FIG. 2, illustrating the second of the variable length nozzles.

With reference now to FIG. 1, the sealed rotary cone rock bit, generally designated as 10, consists of rock bit body 12, pin end 14 and the cutting end comprising three rotary cones, generally designated as 16. Each of the cones are attached to a leg 20 that terminates in a shirttail portion 22. Each of the cones, for example, contain a multiplicity of equally spaced tungsten carbide inserts 18, interference fitted within the cone body. It would be obvious to utilize other cutting structures, such as milled teeth, formed in the cone 16 (not shown). Three nozzle bodies of varying length 24, 28 and 32 extend downwardly from bit body 12. Each of the nozzle bodies incorporate separate nozzles 25, 29 and 33 that are threaded into complementary threaded receptacles 27, 31 and 35 in the end of the nozzle bodies (FIGS. 3 through 5).

Figure 2:
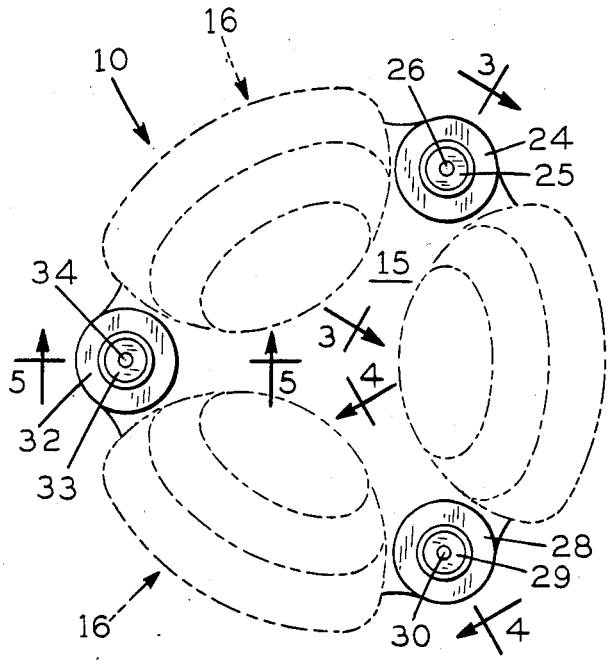
FIG. 2 is an end view looking at the cutting end of the rock bit, illustrating the positions of each of the variable length nozzles of the bit.

FIG. 2 illustrates the orientation of each of the varying length nozzle bodies 24, 28 and 32. The nozzle body extending from dome 15 having the shortest length is nozzle body 24. A separate threaded nozzle 25 is threadably engaged with a threaded receptacle 27 formed in the end of nozzle body 24 (FIG. 3). The nozzle has formed therein an exit or orifice opening 26. The size of the exit opening determines in part the velocity at which the fluid is ejected through the opening 26 towards the borehole bottom 44 (FIGS. 3, 4 and 5).

An intermediate nozzle body 28 is formed about 120° from the nozzle body 24 and also extends from dome 15 of rock bit body 12. Nozzle body 28 is, for example, threaded. The threaded body 29 threadably engages within threaded receptacle 31 in the end of the extended nozzle body 28.

Figure 5:
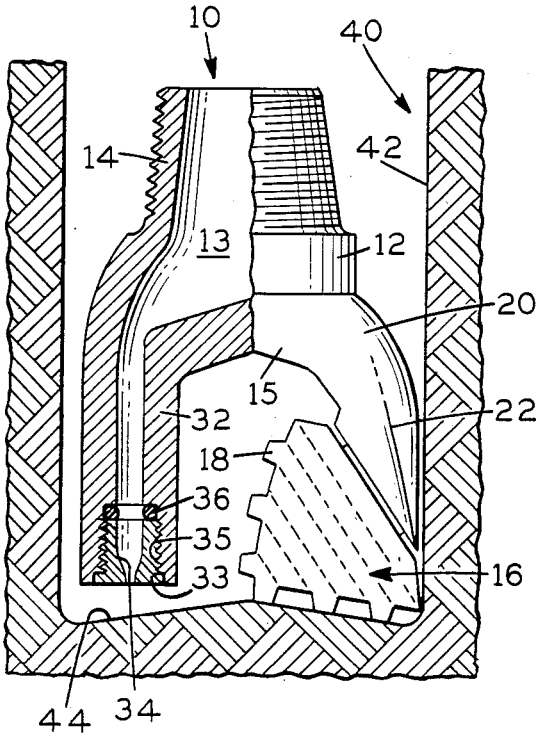
FIG. 5 is a partially cut away side view taken through 5—5 of FIG. 2, illustrating the third variable length nozzle, the end of the nozzle being closest to the borehole bottom.

Nozzle body 32, extended, again, from dome 15 of the bit body 12, is positioned adjacent the borehole bottom 44 (as shown in FIG. 5). Nozzle body 32 has, like nozzle bodies 24 and 28, a threaded nozzle 33 threadably engaged within threaded receptacle 35 in the end of the extended nozzle body 32. Again, a nozzle opening or exit 34 is formed within the nozzle 33.

With reference now to FIG. 3, the partially cut away rock bit 10 is shown with pin end 14 of body 12 forming an opened fluid chamber 13. Fluid chamber 13 communicates with extended nozzle body 24 which has a threaded receptacle end 27 adapted to receive threaded nozzle 25 therein. At the base of the threaded nozzle 25 is positioned a rubber O-ring 36 to provide a seal, thereby preventing erosion between the threaded nozzle 25 and the extended nozzle body 24. The orifice or exit opening 26 is formed in the nozzle and its diameter partly determines the velocity of fluid that is ejected through the nozzle opening 26. The distance from the end of the nozzle 25 and the borehole bottom 44 is the greatest distance of each of the variable length nozzle bodies 28 and 32. Fluid exiting the nozzle orifice 26 is directed towards the borehole bottom 44 of borehole 40 and, since the distance is relatively long, the velocity of the exiting fluid from the nozzle is reduced before it reaches borehole bottom 44. It can readily be seen that the nozzle body 24 extends from dome portion 15 which serves to close out the bottom of chamber 13, the dome being formed in bit body 12.

FIG. 4 illustrates the intermediate variable length nozzle body 28. The distance from the end of the extended nozzle body 28 and the borehole bottom 44 is intermediate of extended nozzles 24 and 32. A separate threaded nozzle 29 is threadably engaged within complementary threaded receptacle 31, the base of the nozzle 29 seating against a compressed O-ring 36. Again, the nozzle 29 forms an internal orifice or exit passage 30. The orifice size determines the velocity of fluid passing through the nozzle opening towards the borehole bottom 44. It can be readily realized then that, since the end of the extended nozzle body 28 is closer to the borehole bottom 44, the impact of the fluid striking the borehole bottom 44 would be greater than the impact of the fluid striking the bottom from nozzle 25. Fluid then would tend to move from nozzle 29 towards nozzle 25 because of the greater velocity of the fluid being ejected from the nozzle 29, thus creating a crossflow movement of fluid from the area of impact from nozzle 29 towards the area of impact from nozzle 25.

Finally, with reference to FIG. 5, extended nozzle body 32 extends the greatest distance from the dome 15 of the rock bit 10. A threaded nozzle 33 is threadably engaged with a complementary threaded receptacle 35 in the end of the extended nozzle body 32. As before, a compressed O-ring is placed at the base of the threaded nozzle 33 to prevent internal erosion of fluid as it passes by the end of the nozzle 33. Again, nozzle opening 34 is formed in threaded nozzle 33. Since the extended nozzle body 32 is positioned adjacent to the borehole bottom 44, the accelerated fluids through the nozzle 33 are stronger and have greater impact than the exiting fluids from nozzles 29 and 35. Hence, fluid will tend to circulate across the borehole bottom 44 from the extended nozzle body 32 towards the intermediate variable length nozzle body 28 and, from there, towards the shortest extended nozzle body 24. A circular crossflow or turbulence is generated on the borehole bottom 44 that tends to lift the cuttings or detritus from the borehole bottom through the annulus formed between the drill pipe and borehole walls 42 towards the top of the drill rig (not shown).

It would be obvious to attach the nozzles 25, 29 and 33 into the end of the variable length nozzle bodies 24, 28 and 32 through other than threaded means. For example, the nozzles 25, 29 and 33 could be retained through a well-known nail retention system whereby a nail or rod is driven into complementary annular, indexed circumferential slots formed between the nozzle bodies and the extended nozzles (not shown).

Moreover, the nozzles 25, 29 and 33 could be retained through a snap ring positioned adjacent the ends of the nozzles to retain the nozzles within the extended nozzle portions 24, 28 and 32.

It would also be obvious to form an opening in the ends of each of the variable length nozzle bodies 24, 28 and 32 without the use of separate nozzles 25, 29 and 33—the important thing being that the plane of the exiting fluid be at varying lengths from the borehole bottom, as taught in this invention, to create a circulation or crossflow of fluid on the borehole bottom to lift detritus therefrom.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

I claim:

1. A three-cone sealed bearing rock bit of the type that utilizes drilling fluid during operation of the rock bit in an earth formation comprising:

a rock bit body having a first pin end and a second cutting end, said cutting end consisting of rotary cones mounted to journals that are cantilevered radially inwardly from legs extending from said rock bit body, a fluid chamber formed by said body, said fluid chamber is opened at said first pin end of said body, and at least three variable length nozzle bodies positioned about 120° one from the other, extend from a dome portion formed at a base of said bit body toward a bottom of a borehole in said earth formation, each of said nozzle bodies communicate with said fluid chamber in said body and extend a different length from said dome portion, an exit end therefor, of each of said nozzle bodies is at a different length from said bottom of said borehole, a first nozzle body terminates about flush with said dome formed in said rock bit body, a second nozzle body terminates about halfway between the lowermost point of said cutting end and said dome and the third nozzle body terminates just above the lowermost point of said cutting end, said variable length nozzle bodies result in varying fluid flow velocities at the borehole bottom thereby creating a turbulent crossflow of said fluid on said borehole bottom thus more efficiently lifting detritus from the borehole bottom, resulting in greater rock bit penetration in said earth formation.

2. The invention as set forth in claim 1 wherein each of the three variable length nozzle bodies have individual nozzles fastened into receptacles formed in the exit end of said nozzle body, the nozzles being formed of hardened material.

3. The invention as set forth in claim 2 wherein each of the individual threaded nozzles have different size nozzle orifices formed in said nozzle bodies to further affect the flow rate of fluid exiting from the varying length nozzle bodies.

4. A rotary cone rock bit of the type that utilizes drilling fluid during operation of the rock bit in an earth formation comprising:

a rock bit body having a first pin end and a second cutting end, said cutting end consisting of one or more rotary cones mounted to journals that are cantilevered radially inwardly from legs extending from said rock bit body, a fluid chamber formed by said body, said fluid chamber is opened at said first pin end of said body, and at least three variable length nozzle bodies extend from a dome portion formed at a base of said bit body toward a bottom of a borehole in said earth formation, each of said nozzle bodies communicate with said fluid chamber in said body and extend a different length from said dome portion, an exit end therefor, of each of said nozzles is at a different length from said bottom of said borehole, a first nozzle body is about flush with said dome formed in said rock bit body, a second nozzle body is extended about halfway between the lowermost cutting end and said dome and the third nozzle body is positioned just above the lowermost cutting end; said variable length nozzle bodies result in varying fluid flow velocities at the borehole bottom each of the nozzle bodies have different size nozzle exit orifices formed in said nozzle bodies to further affect the flow rate of fluid exiting from the varying length nozzle bodies, thereby creating a turbulent crossflow of said fluid on said borehole bottom thus more efficiently lifting detritus from the borehole bottom, resulting in greater rock bit penetration in said earth formation.

5. The invention as set forth in claim 4 wherein the turbulent crossflow of said fluid on said borehole bottom is substantially circular to more efficiently lift detritus from said borehole bottom.

* * * * *

UNITED STATES PATENT AND TRADEMARK OFFICE

CERTIFICATE OF CORRECTION

PATENT NO. : 4,665,999

DATED : May 19, 1987

INVENTOR(S) : Ken S. Shoemaker

It is certified that error appears in the above-identified patent and that said Letters Patent is hereby corrected as shown below:

On the title page Insert

--(73) Assignee: Smith International, Inc.,
Newport Beach, Calif.--.

Signed and Sealed this

Twenty-ninth Day of March, 1988

*Attest:*

DONALD J. QUIGG

*Attesting Officer*

*Commissioner of Patents and Trademarks*